United States Patent [19]

Wendt

[11] 4,227,355

[45] Oct. 14, 1980

[54] SUPPORT SYSTEM FOR SOUND ABSORBING PANELS

[75] Inventor: Alan C. Wendt, Barrington, Ill.

[73] Assignee: United States Gypsum Company, Chicago, Ill.

[21] Appl. No.: 891,864

[22] Filed: Mar. 30, 1978

[51] Int. Cl.[2] ..... E04B 7/16

[52] U.S. Cl. ..... 52/64; 49/409; 248/343; 160/196 R

[58] Field of Search ..... 49/404, 405, 409; 160/181, 196, 201; 52/64, 145, 489; 248/343

[56] References Cited

U.S. PATENT DOCUMENTS

| | | | |
|---|---|---|---|
| 629,165 | 7/1899 | Larson . | |
| 1,100,826 | 6/1914 | Gunn | 49/409 |
| 1,610,282 | 12/1926 | Hanson . | |
| 2,252,070 | 8/1941 | French . | |
| 2,423,199 | 1/1947 | Milnor . | |
| 2,519,161 | 8/1950 | Tucker . | |
| 2,866,225 | 12/1958 | Ward . | |
| 2,959,807 | 11/1960 | Johnson . | |
| 2,980,946 | 4/1961 | Del Faro et al. . | |
| 3,020,988 | 2/1962 | Bransford . | |
| 3,081,853 | 3/1963 | Battriss . | |
| 3,131,447 | 5/1964 | Tinnerman . | |
| 3,140,071 | 7/1964 | Lorentzen . | |
| 3,140,564 | 7/1964 | Chapman . | |
| 3,203,142 | 12/1965 | Narmore . | |
| 3,357,148 | 12/1967 | Turner . | |
| 3,371,900 | 3/1938 | Jacobs | 248/343 |
| 3,620,376 | 11/1971 | Gingher . | |
| 3,713,508 | 1/1973 | Echel . | |
| 3,740,898 | 6/1973 | McKenzie . | |
| 3,748,793 | 7/1973 | Tompkins | 52/64 |
| 3,934,382 | 1/1976 | Gartung . | |
| 4,016,889 | 4/1977 | Wendt . | |
| 4,031,664 | 6/1977 | Wendt | 49/409 |

FOREIGN PATENT DOCUMENTS

| | | | |
|---|---|---|---|
| 271966 | 2/1964 | Australia | 52/145 |

*Primary Examiner*—Price C. Faw, Jr.
*Assistant Examiner*—Henry E. Raduazo
*Attorney, Agent, or Firm*—Glenn W. Ohlson; Robert H. Robinson; Kenneth E. Roberts

[57] ABSTRACT

A hanger bracket is disclosed for supporting and connecting sound absorption panels wherein the panels have a top frame member with a depending lip portion. The hanger bracket is usable for both fixed and movable sound absorption walls. The hanger bracket is comprised of two substantially identical bracket members having upper and lower generally vertical plates residing in offset substantially parallel planes. The bracket members are connected to each other, and to the support member, by connector means at the upper vertical plates. The lower plates have at least one punched-out tab portion extending generally inwardly then upwardly which engage the depending lip of the panel frame to thereby support the panel.

The hanger bracket is attachable to both a fixed support member and to a movable trolley support member. A fixed sound absorption wall having one or more sound absorbing panels is provided wherein the hanger bracket supports the panels and is secured to a fixed support member. A movable sound absorption wall is disclosed wherein one or more sound absorbing panels are movably supported by the hanger bracket which is attached to a horizontally movable trolley engaging a support track.

25 Claims, 10 Drawing Figures

SUPPORT SYSTEM FOR SOUND ABSORBING PANELS

THE BACKGROUND OF THE INVENTION (1) Field of the Invention

This invention relates to a hanger bracket comprising two substantially identical members for supporting sound absorbing panels in both a fixed and movable sound absorption wall system.

(2) Description of the Prior Art

In recent years, the construction industry has become increasingly aware of noise pollution, and, consequently there has arisen the need for effective sound absorption systems. In the past, such sound absorption systems have generally been sound absorbing panels attached to a supporting structure such as a wall. In many applications, however, the sound absorption is required in the middle of an already constructed room in order to isolate a sound source. There is also an additional requirement in these situations that the sound absorption system be movable in order to enable the continuation of an established flow of goods or traffic, that had developed prior to the need to isolate the sound source, after the need to isolate it has ended. Along with the requirement for movability, the need has also arisen to utilize a combination of movable and fixed sound absorption walls to produce desirable wall alignments which utilize the properties of both kinds of wall systems. In this situation, the need may be to immovably enclose three sides of a generally rectangular area but allow a fourth wall to be horizontally movable to provide access to the area having a machine or other sound emitting source. In the past, the methods useful for accomplishing this noise abatement were limited to constructing a new wall and using conventional sound absorbing panels, or providing some type of drapery material depending from the ceiling. Recent methods have involved providing demountable and movable sound absorption panels. The problems with these more recent systems arise from the fact that multitudinous components are required and installation costs become high thus inhibiting the flexibility desirable for the fast and economical relocation of the sound absorbing wall to other required noise emission locations. In the older methods, it is seen that the construction of a new wall is expensive and fails to provide movability and demountability required in flexible floor plan locations. With the use of mere drapery, sound absorption which could be found in conventional sound absorbing panels is lost and additionally, a lack of strength in the material is present when required to extend vertically for large distances.

One older example of a sound absorbing wall utilizing modular panel construction is shown in U.S. Pat. No. 2,423,199, issued to Milnor, wherein sound absorbing material is enclosed by a frame and provided with a foraminous facing. The manner of installing these panels is however disclosed to be by the locking insertion of panel members between channel or studding supports. Horizontal movability of the wall is prohibited and ease of demountability is similarly absent. A folding screen-like system is found in U.S. Pat. No. 3,713,508, issued to Eckel, which discloses a sound absorbing structure having sound absorbing material provided in two separated compartments. Hinged modular units are provided in a free-standing configuration without securement to structural supporting members of a building or the like. In U.S. Pat. No. 3,934,382, issued to Gartung, a sound absorbing screen assembly is provided utilizing sound absorbing panels slidably mounted in upright channel base members. Although providing movability and demountability, the free standing screen disclosed in this patent cannot be provided where large vertical distances are encountered and support from upper support members is necessary to attain the strength and rigidity required, such as in factory or industrial locations.

Other specialized industrial sound absorbing wall systems and mountings have been used. An acoustic testing structure is disclosed in U.S. Pat. No. 2,519,161, issued to Tucker, and provides significant sound absorbing structures for testing machines and the like in heavy industrial situations. However, its practicality in providing a conventional room-like situation is limited since it by necessity requires a battery of parallel sound panels spaced on center which permit the passage of air fumes and sound waves through a tunnel-like structure provided. Movable walls having fixed floor runner tracks have been used but the floor tracks pre-determine the wall locations. A movable partition assemby for sound insulating panels is provided in U.S. Pat. No. 3,140,564, issued to Chapman. In this patent, a pivotably mounted floor channel is required to be constructed within existing flooring. The wall partitions are slidably aligned between opposing pivotably mounted floor channel members but no disclosure of upper support is expressed therein. The invention provides demountability and horizontal movability useful only at the lower edges of the sound insulation curtain, but the utilization of fixed or movable upper support was not shown. Industrial noise abatement walls necessitate the supportive attachment at upper edges to provide adequate stability and strength.

In two related patents issued to me, U.S. Pat. Nos. 4,016,689 and 4,031,664, a sound absorbing panel useful in this present invention is therein provided. In the former, a clip is shown useful for adjoining juxtaposed sound panels but does not provide hanger bracket attachment capabilities useful for support to a fixed support member or movable trolley-like member. The connective clip thus shows interconnective means for sound absorbing panels at junctures away from support member locations. In the latter patent, a hanger is provided which does allow demountability and horizontal movability along a track. In providing horizontal movability additional components are however necessary such as a slotted connection clip requiring a rod and pin to interconnect the hanger with the horizontally movable trolley assembly. The present invention provides an improvement in horizontal movement capability and fixed wall attachment in a sound absorption wall. No additional problem with the clip shown in said U.S. Pat. No. 4,031,664, is encountered at panel corners where the vertical and horizontal frame members are connected by fastener means having heads such as is common with conventional screw fasteners. The heads of these fasteners abut against the inside vertical planar surfaces of this clip and thereby prevent flush contact between the clip and the secured panels. It is also necessary, when using this clip in situations where a channel member having a C-shape or the like is used, to have the opening disposed upwardly. This is necessary so that the upper horizontal plates of the clip members may be interconnected by a screw means which passes therethrough and avoid contacting metal planar surfaces as would be the situation if the opening of a C-shaped channel were not disposed upwardly. In providing interconnection between the channel member and clip, a spring and additional support member are provided within the gap of the channel member to provide a fixed sound absorption wall configuration.

It is thus seen with this cross-section of prior art attempts, the attainment of horizontal movability and ease of demountability while retaining simplistic structures and facile installation has been a problem plaguing the construction industry. Prior to this time, there has not been developed an efficient sound absorption system which has all the advantages of providing sound absorption for noise sources but which is readily relocatable and horizontal movable using non-complex components to meet industrial needs. The new and useful system provided by this invention is the first system which comes forth to fulfill all the needs of the industry.

(3) Objects of the Invention

It is an object of this invention to provide a hanger bracket for attaching and supporting sound absorbing panels.

It is a further object of this invention to provide a hanger bracket for attaching sound absorbing panels in a fixed condition to a support member.

It is therefore a corresponding objective of this invention to provide a hanger bracket for movably attaching sound absorbing panels to a movable trolley.

It is an additional object of this invention to provide a hanger bracket useful in connecting sound absorbing panels.

It is an aligned object of this invention to provide a low cost easily assembled sound absorbing panel system.

It is also an object of this invention to provide a hanger bracket having interchangeable bracket members having substantially identical structures.

An important object of this invention is to provide a sound absorption wall system having a hanger bracket usable for both a fixed wall system and a horizontally movable wall system which overcomes all the problems associated with the prior art.

SUMMARY OF THE INVENTION

The objects of this invention are accomplished by a hanger bracket comprising two opposing substantially identical bracket members for securing one or more sound absorbing panels to a fixed support member. The bracket members have upper and lower generally vertical plates residing in offset substantially parallel planes. The lower plate has at least one punched-out tab portion extending generally inward then upward from the lower plate. The bracket members are connected to each other, and are secured to the support member, by connector means at said upper vertical plates. The sound absorbing panels have a top frame member with a depending lip portion wherein the punched-out tab portions engage the depending lip of a panel frame to thereby support the panel.

In further attaining the objects of this invention, the hanger bracket comprising two opposing substantially identical bracket members is usable for movably securing one or more sound absorbing panels to a horizontally movable trolley means. The trolley means is movably attached to a support track. The bracket members are connected to each other, and secured to said trolley means, at said upper vertical plates. The punched-out tab portions engage a depending lip of the panel frame to thereby support the panel and provide horizontal movability in a path along the support track.

The bracket members comprising the hanger bracket of this invention are of one piece integral construction and have a horizontal portion extending outwardly a distance less than one-half the width of the panel frame member at generally right angles to the upper plate from a lower edge thereof. This horizontal portion terminates at an edge opposite the upper plate in an intermediate vertical plate depending downwardly at generally right angles to the horizontal portion. The intermediate vertical portion has a lower skewed portion skewed obliquely outwardly therefrom. The skewed portion terminates at an edge opposite the intermediate vertical portion in a lip portion extending outwardly in a generally horizontal plane. The lip is connected at an edge opposite the skewed portion to the lower vertical plate portion. When the bracket members are opposingly connected, the lip portions of each bracket member contact opposing upper outer corner portions of the panel top frame. Similarly, the vertical plate portions contact outer surfaces of the depending lip portions of the panel frame member.

A hollow generally rectangular opening is formed between the bracket members when they are connected. In conformance with this invention, the support member may comprise a box C-shaped channel member which is supported by rigid support members and is secured within the hollow generally rectangular bracket opening: Said rectangular opening having sides being the intermediate vertical plates of the opposing bracket members, the bottom of the rectangular opening being the panel frame, and the top of the rectangular opening being the horizontal portions of the bracket members. When the bracket members are connected together at upper vertical plates, the channel member is secured between said members in said rectangular hollow opening. In the movable sound absorption walls, in accordance with this invention, a box C-shaped channel member may be provided for additional strength and rigidity within said hollow rectangular opening and along the top of the panel frames, but in this case does not offer wall support because the bracket members are otherwise engaged at the upper vertical plate portions to the movable trolley means. However, the C-shaped channel used in this movable wall provides connective bridging across the juncture at adjacent panels which increases wall strength and thereby also reduces the number of trolleys.

The objects of this invention are additionally reached by the provision of a fixed sound absorption wall. This wall comprises one or more sound absorption panels supported by top frame members. A hanger bracket is therefore provided having two opposing substantially identical members engaging the top frame members. Connecting means is provided for connecting the bracket members to each other and securing the hanger bracket to a support member thereby supporting the sound absorption panels. The fixed sound absorption wall utilizes panel frame members having depending lip portions. The bracket members have upper and lower generally vertical plates residing in offset substantially parallel planes and the lower plate has at least one punched-out tab portion extending generally inwardly then upwardly from the lower plate. The bracket members are connected to each other and secured to the support member by connector means at said upper vertical plates. The punched-out tab portions engage a depending lip of the panel frame and thereby support the panel.

The support member of the fixed sound absorption wall may be a box C-shaped channel. When the bracket members are connected they form a hollow generally rectangular opening therebetween. The box C-shaped channel support member extends along the top frame of the panel and is secured within the hollow generally rectangular opening formed by the connected bracket members: Said rectangular opening having sides being intermediate vertical plates of opposing bracket members, the bottom of the rectangular opening being the panel frame, and the top of the rectangular opening being horizontal portions of the bracket members. The support member, rather than being a C-shaped channel, may simply be other conventional ceiling support members wherein the upper vertical plate of each bracket member has at least one opening therethrough with connector means inserted therein to connect the bracket member to the support member.

A critical goal of this invention is attained by the provision of a horizontally movable sound absorption wall. This wall has one or more sound absorbing panels supported by top frame members. A hanger bracket is provided having two opposing substantially identical members engaging the top frame member. A support track is provided and a movable trolley means engages the support track for guiding movement along the tracks. Connector means are utilized attaching the bracket members to the trolley means to support the panels and enable the panels to be moved horizontally in a path along the support track. In conformance with this horizontally movable sound absorption wall the panel frame members have depending lip portions. Bracket members have upper and lower generally vertical plates residing in offset substantially parallel planes. The lower plates have at least one punched-out tab portion extending generally inwardly then upwardly from the lower plate wherein said punched-out tab portions engage a depending lip of the panel frame. The bracket members are connected to each other by connector means at the upper vertical plates and the bracket members are connected to the trolley means at said upper vertical plates by other connector means.

In providing a horizontally movable sound absorption wall additional strength and rigidity may be provided by utilizing a box C-shaped channel member along the panels top frame. This channel member is secured within the hollow generally rectangular bracket opening formed by the connection of opposing bracket members when the bracket members are connected to each other by connector means at their upper vertical plates.

Other important objects of this invention are attained by providing the upper vertical plate of each bracket member with at least one inwardly indented pocket portion in positional correspondence with an inwardly indented pocket portion on the other. Pocket portions have openings centered therein with connector means inserted therethrough to thereby connect the bracket members. The pocket portions abut one another at inward facing surfaces thereby offsetting the upper vertical plates in parallel planar relationship. This offset planar relationship allows for insertion of a support member or trolley means therebetween so as to sandwich the member and allow for connection of the bracket members. Also, the lower vertical plates may be provided with an outward extending embossment which extends outwardly a distance sufficient to accommodate fastener heads located on the panel frame members at upper corners. In providing this embossment, the lower vertical plate inward planar surface is permitted to reside in flush planar contact with panel frame surfaces to avoid abrasive contact with the panel frame fastener heads.

A preferable sound absorption panel utilized in attaining the objects of this invention has a generally rectangular shape. The panel includes a sound absorbing material completely enclosed within a heat shrunk plastic material. It is desirable that the supporting frame member extend about the outer edge of the enclosed sound absorbing material. A useful frame member has a U-shaped cross-section.

Still other objects will readily present themselves to one skilled in the art upon reference to the following Specification, drawings and Claims.

BRIEF DESCRIPTION OF THE DRAWINGS

This invention may be more fully described, but is not limited, by the attached drawings wherein.

DESCRIPTION OF THE PREFERRED EMBODIMENTS

This invention may be more fully described, but is not to be limited, by reference to the attached drawings and the discussed preferred embodiments.

Figure 1:
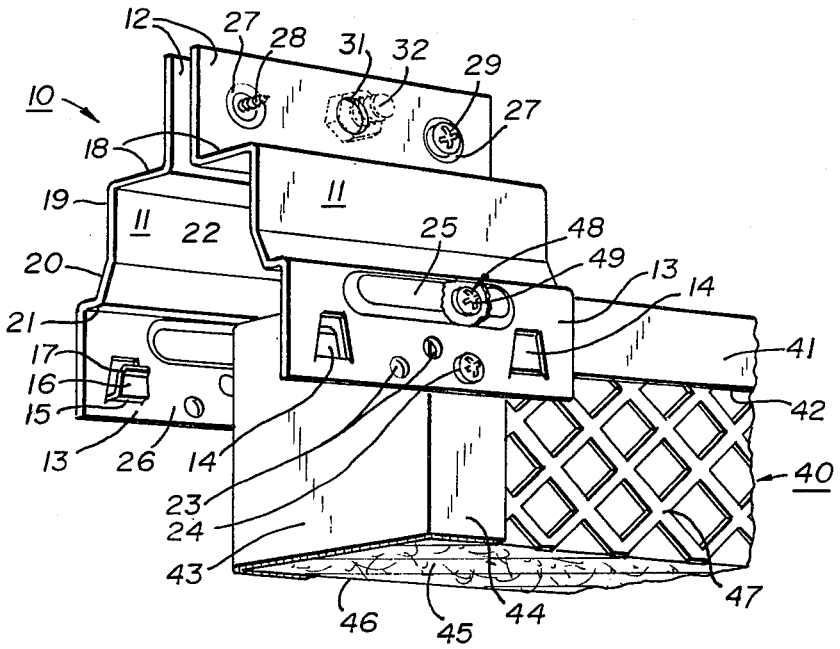
FIG. 1 is a perspective view of an embodiment of the hanger bracket of this invention, showing two bracket members opposingly connected and supporting a sound absorption panel.
Figure 2:
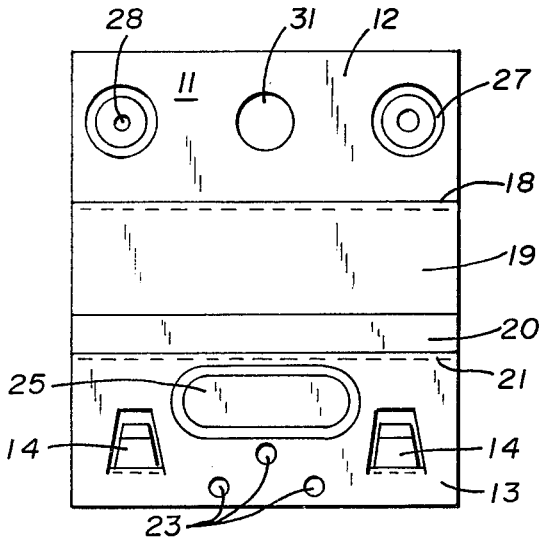
FIG. 2 is a front view of one of the hanger bracket members shown in FIG. 1.
Figure 3:
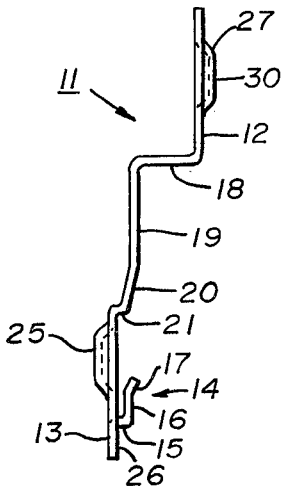
FIG. 3 is an end view of one of the hanger bracket members as shown in FIG. 1.

Referring to FIGS. 1, 2 and 3, hanger bracket 10 is shown to be comprised of substantially identical bracket members 11 opposingly connected for support of sound absorption panel 40. Each bracket member 11 is preferably of one piece integral construction. Bracket member 11 has an upper vertical plate 12 having attached from its lower edge a horizontal portion 18 which extends outwardly at generally right angles to the plane of upper vertical plate 12. Horizontal portion 18 terminates at an edge opposite the vertical plate 12 with an intermediate vertical plate 19 depending downwardly at generally right angles. Intermediate vertical plate 19 terminates at its lower end with an obliquely angled skewed portion 20 which extends at an oblique angle outwardly therefrom. At the end of skewed portion 20 opposite intermediate vertical plate 19 a generally horizontal lip portion 21 extends therefrom a relatively short distance. At the outward edge of lip portion 21 lower vertical plate 13 extends downwardly at generally right angles to lip portion 21. In the preferred embodiment lower vertical plate 13 is provided with punched-out tab members 14 which extends first inwardly at inward portion 15 then upwardly at upward portion 16 and terminates with a bent end 17. As seen in FIG. 1, punched-out tabs 14 facilitate engagement between sound absorption panel 40 and hanger bracket 10.

Upper vertical plate 12 is desirably provided with two inwardly indented pocket portions 27 having openings 28 centered therein. Connecting bracket members 11 together are connector means 29 inserted through openings 28. Pocket portions 27 have inward facing surfaces 30 which opposingly contact one another when the bracket members 11 are mated. Additionally, it is preferable for upper vertical plate 12 to be provided with an aperture 31 generally centered between pocket portions 27. Through opposing apertures 31 a connector means 32 is disclosed for connecting the hanger bracket 10 to upper support members (not shown in FIG. 1). Connector means 32 is desirably a nut and bolt fastener.

As shown in FIG. 1, sound absorption panel 40 is shown to have a panel top frame 41 having a generally U-shape wherein depending lips 42 comprise the arms of the U. Also provided, is a panel side frame 43 similarly having a U-shape and having lips 44. In this preferred embodiment, panel top frame 41 and panel side frame 43 are separate frame elements and are not integral about the perimeter of the sound absorption panel. At corner junctures, shown in the broken away portion of this Figure, panel frame fasteners 48 are therefore provided to connect the top and side frame members. In this embodiment of the invention, panel frame fasteners 48 are preferably sheet metal screw fasteners having fastener heads 49 which project outwardly from the panel framing. In this configuration, an outwardly extending embossment 25 is provided at lower vertical plate 13 to house fastener heads 49 within and to allow the inward planar surface 26 of lower vertical plate 13 to flushly contact the panel frame surfaces and eliminate abutting abrasive interference which would be present along inward planar surface 26 absent embossment 25.

With further reference to FIGS. 1, 2 and 3, it is desirable to provide additional fastening means between hanger bracket 10 and the supported sound absorption panel 40. For this reason it is preferable to have a plurality of panel connector holes 23 in lower vertical plate 13 generally centered between punched-out tab members 14. Extending through panel connector holes 23, screw fasteners 24 engage the frame of sound absorption panel 40. Sound absorption panel 40 is thus supported by punched-out tabs 14 and additionally secured by means of screw fasteners 24.

When opposing bracket members 11 are connected by connector means 29 they assembly to provide a hollow generally rectangular opening 22 therebetween. The sides of generally rectangular opening 22 are provided by intermediate vertical plates 29 as they opposingly face each other. The upper surface is provided by the horizontal portions 18 of bracket members 11. And, the bottom side of the rectangle comprises the panel top frame 41.

With particular reference to FIG. 1, it is seen in this embodiment of the invention that lip portion 21 is provided to maintain sound absorption panel 40 in place by preventing upward vertical displacement. Panel top frame 41 is thereby prevented from moving upwardly beyond the generally horizontal plane within which lip portion 21 resides. It is accordingly desirable to limit the width of each opposing horizontal portion 18 to less then one-half the width of panel top frame 41 so that when bracket members 11 are connected the opposing lower vertical plates 13 are in adjacent horizontal alignment with the depending lip 42 of panel top frame 41 to permit punched-out tabs 14 to engage said lips. Also, as seen from this preferred embodiment, it is necessary that skewed portion 20 be provided to enable attachment of bracket members 11. To engage depending lips 42 the punched-out tabs 14 must be moved vertically such that depending lips 42 are located between inward planar surface 26 and punched-out tabs 14. Skewed portion 20 allows this installation step to take place by a simple vertical movement without bending punched-out tab 14. If skewed portion 20 was not provided then the panel frame corners would contact intermediate vertical plate 19 during installation and force the deforming bending of the punched-out tabs 14 to enable lip 21 to rest over the frame corners. In preventing needless bending of punched-out tab 14, tight securement of sound absorption panel 40 is provided by the engagement of punched-out tabs 14 with depending lips 42.

Figure 4:
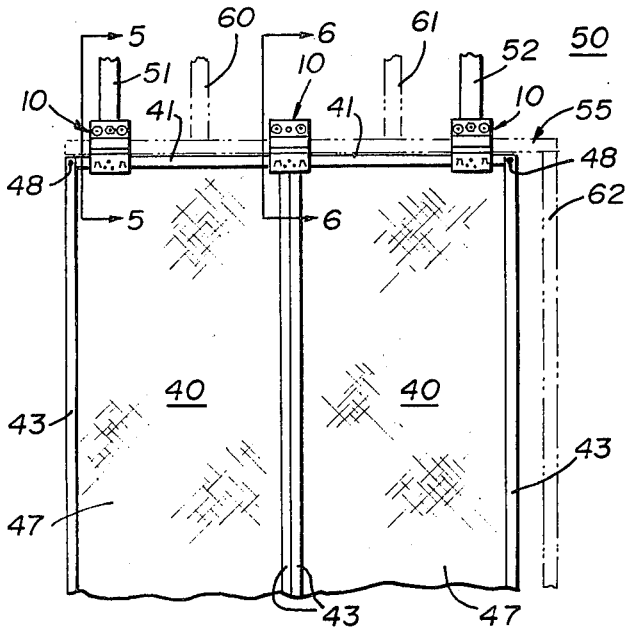
FIG. 4 is an elevational view of a fixed sound absorption wall in accordance with this invention which additionally shows (in phantom) the alternate utilization of a channel as a support member.
Figure 5:
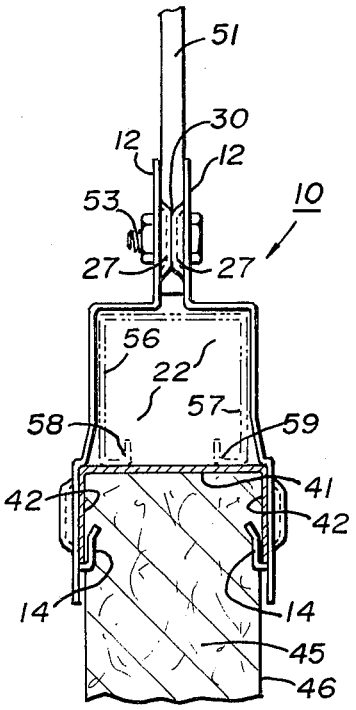
FIG. 5 is a cross-sectional view taken along line 5—5 of FIG. 4, looking in the direction of the arrows, showing the hanger bracket of this invention fixedly supporting sound absorption panels to a typical rigid upper support member and additionally shows (in phantom) the alternate embodiment where the support member is a channel.
Figure 6:
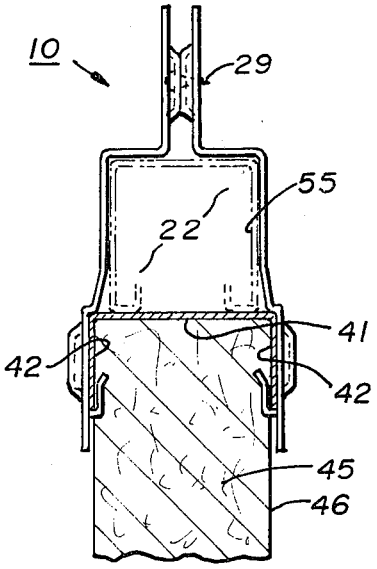
FIG. 6 is a cross-sectional view taken along lines 6—6 of FIG. 4, looking in the direction of the arrows, showing the hanger bracket of this invention utilized at panel junctures as a panel connector means.

Turning now to FIGS. 4, 5 and 6, fixed sound absorption wall 50 is shown as a preferred embodiment of the invention disclosed. Rigid support members 51 and 52 provide the upper support for the wall 50. These support members 51 and 52 are desirably subpurlins or other substructures depending from an upper ceiling (not shown). Hanger brackets 10 are attached to support members 51 and 52 by connector means 53 passing through aperture 31 of the bracket members 11 and engaging said support members 51 and 52 sandwiched therebetween. The desirable embodiment provides connector means 53 in the form of a nut and bolt conventional fastener means. As seen from the cross-sectional view depicted in FIG. 5, sound absorption panels 40 are secured by means of depending lips 42 engaged by punched-out tabs 14. The securement between hanger bracket 10 and the rigid upper support members 51 and 52 necessarily prevents horizontal movablility. This embodiment of the invention is desirable in those situations where access from one side to the other of the wall is not necessary. However, ease of demountability is provided in that connector means 53 may be removed without damage to the brackets, panels, or upper support members.

Referring now to FIG. 6, the operability of hanger bracket 10 for use as merely a connective device is disclosed. In this figure, opposing bracket members 11 are connected by connector means 29 engaging openings 28 centered in pocket portions 27. The advantages of the hanger bracket of this invention is thus shown by its interchangeable function as a connective device without requiring additional elements.

Again, turning to FIG. 5, it is seen that the connection to support member 51 is intermediate the inwardly indented pocket portions 27. Bracket members 11 are connected one to the other by connector means 29 on either side of bracket member 51. Amid the pocket portions 27, connector means 53 engages both bracket members 11 by passing through apertures 31 and engaging support member 51 in sandwich-like manner between the upper vertical plates 12. It is thus seen to be preferable to provide the depth of the indentation for pocket portion 27 to be approximately one-half the width of a support member such that when opposing bracket members 11 are connected, the inward facing surfaces 30 of pocket portions 27 abut one another and, because they are indented inwardly, provide a space for support member 51 to be supportively inserted between the upper vertical plates 12. This conformation prevents bending and distortion of the plates as they receive interconnective devices being connector means 29 connecting the bracket members.

A preferable alternate support means is disclosed in FIGS. 4, 5 and 6, with phantom lines. A channel member 55 best described as having a box C-shape is provided. Its conformation is such that it may be secured and reside within the hollow rectangular opening 22 which is created by the opposing connection of bracket members 11 of hanger bracket 10. As connector means 29 interconnect the bracket members 11, channel member 55 is thereby secured between them within said rectangular opening 22. As shown in FIG. 4, channel member 5 resides substantially the full horizontal distance along panel top frame members 41 of sound absorption panels 40. Securement to channel member 55 may be made by hanger bracket 10 at any point along the length of the channel member 55, other than, of course, at support member locations. It is preferable, that channel member 55 be supported by upper support members 60 and 61. These support members are desirably disclosed to be conventional sub-purlins or other substructures depending from an upper ceiling or roof. Additionally, channel member 55 may be supported by a lower post support member 62 from which channel member 55 would obtain bearing support. Thus the requirement of an upper support member is eliminated by use of the channel member 55 in one embodiment of this invention. The use of a lower post support member 62 may be desirable when the need for abating sound at a location does not require extending fixed sound absorption wall 50 upwardly to unnecessary heights such as in a large factory with extremely high substructure members.

The sound absorption panel disclosed as preferred in fixed sound absorption wall 50 is shown to be a sound absorption panel 40 having a panel top frame 41 and panel side frame 43 supporting a sound absorbing material 45. In another desirable embodiment of this invention, a sound absorption panel 40 having a frame member extending completely about the panel outer edge is also operable. In compliance with this invention it is only necessary that the sound absorbing panel have a sound absorbing material supported by a frame. It has been found that one especially acceptable type of sound absorbing panel is a sound absorbing panel having a sound absorbing material completely enclosed in a heat shrunk plastic material with the enclosed sound absorbing material then supported by the frame. Thus as seen in FIGS. 5 and 6, a heat shrunk plastic material 46 is provided around sound absorbing material 45. The sound absorbing material may be of any type necessary to accomplish requisite sound absorption results, but it has been found to be particularly acceptable to use mineral fiber or glass fiber having a density of from four to six pounds per cubic foot. Preferably, the sound absorbing material may be coated with any conventional heat shrinkable plastic film, examples of which are polyvinyl chloride, polypropylene, polyethylene and the like. A panel facing 47, is also desirable in providing a decorative exposed surface and added strength if so desired. Panel facing 47 is disclosed as being perforated but may as well be non-foraminous.

With the alternate form of support provided by channel member 55 it is seen that a box C-shaped conformation is desirable. This channel member 55 comprises arm members 56 and 57 terminating at inward ends with opposing lip members 58 and 59 extending into the gap of the C. In alignment with this invention, channel member 55 may reside with the opening of the C disposed in any direction but preferably either downward or upward.

Figure 7:
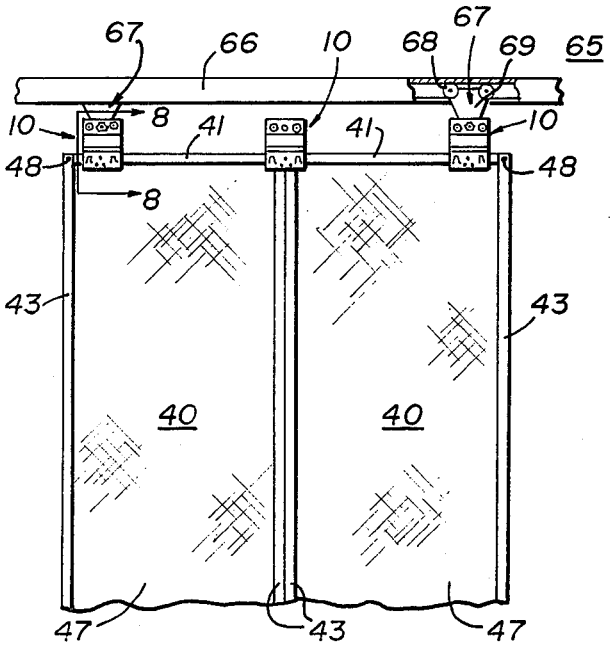
FIG. 7 is an elevational view of a horizontally movable sound absorption wall in accordance with this invention.
Figure 8:
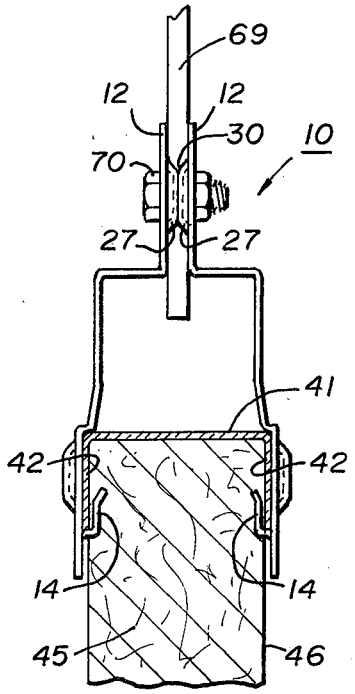
FIG. 8 is a cross-sectional view taken along lines 8—8 of FIG. 7, looking in the direction of the arrows, showing the hanger bracket supporting sound absorption panels and being secured to a conventional trolley means which is movably attached to an upper support track.

Looking now to FIG. 7 and 8, movable sound absorption wall 65 is disclosed as the preferred embodiment providing horizontal movement for a sound absorption wall assembly in compliance with this invention. An upper support track 66 is disclosed movably engaged by trolley means 67. Trolley means 67 is shown to be a conventional trolley means well known to the industry and having wheels 68 movably positioned within the track. As best seen in FIG. 7, trolley means 67 terminates at a lower end with a tapered mounting flange 69 for engagement with hanger bracket 10. In an engagement similar to the attachment to rigid support members 51 and 52 as shown in FIG. 5, a connector means 70 attaches upper vertical plates 12 sandwiched about mounting flange 69. Connector means 70 is preferably a conventional nut and bolt fastener device. This connector means 70 passes through aperture 31 of upper vertical plate 12 to provide an engagement which is similar in manner to the engagement of connector means 53 in the fixed sound absorption wall 50 of FIG. 4.

Turning now specifically to FIG. 8, the depending lips 42 of panel top frame 41 are supportably engaged by punched-out tabs 14. Mounting flange 69 is shown to be sandwiched between upper vertical plates 12 of bracket members 11 and secured therebetween. Not shown in FIG. 8, is a connector means 29 interconnecting opposing bracket members 11. In similar fashion as described with regard to FIGS. 1, 2 and 3, the connector means 29 extend through openings 28 centered in the inwardly indented pocket portions 27, to fasten the bracket members together to form hanger bracket 10. The abutting at the inward facing surfaces 30 of the pocket portions 27 is shown to provide a space between upper vertical plates 12 sufficient to sandwich mounting flange 69 therebetween without bending or deforming the upper vertical plates to facilitate the interconnection of bracket members 11.

Movable sound absorption wall 65 is provided with sound absorption panels 40 having identical characteristics as that disclosed for the preferred embodiment as illustrated with fixed sound absorption wall 50. Namely, a sound absorbing material 45 as previously disclosed is completely enclosed in a heat shrunk plastic bag shown as number 46. As seen in FIG. 7, a perforated panel facing 47 is provided, but may be non-foraminous, or may be eliminated entirely. The panel frame is shown to have panel top frame 41 and panel side frame 43, however, it is alternately desirable to provide a panel frame member extending completely about sound absorption panel 40. The sound absorption panel 40 is disclosed as having a generally rectangular conformation in the embodiments of the invention shown in the drawings.

In the preferred embodiment for movable sound absorption wall 65 shown in FIGS. 7 and 8, no alternate form of support member, such as channel member 55, is envisioned for residing within rectangular opening 22 to provide support. However, it is within the scope of this invention to add stability and rigidity to this movable sound absorption wall 65 by providing a non-supporting channel member 55 within said rectangular opening. When a C-shaped channel member 55 is included, it provides connective bridging across the juncture at adjacent sound absorption panels 40 which increases wall strength and thereby also reduces the number of trolley means 67 in the movable sound absorption wall 65 since several panels may be bridged by the channel member 55 without need for upper support to prevent harmful sagging.

Figure 9:
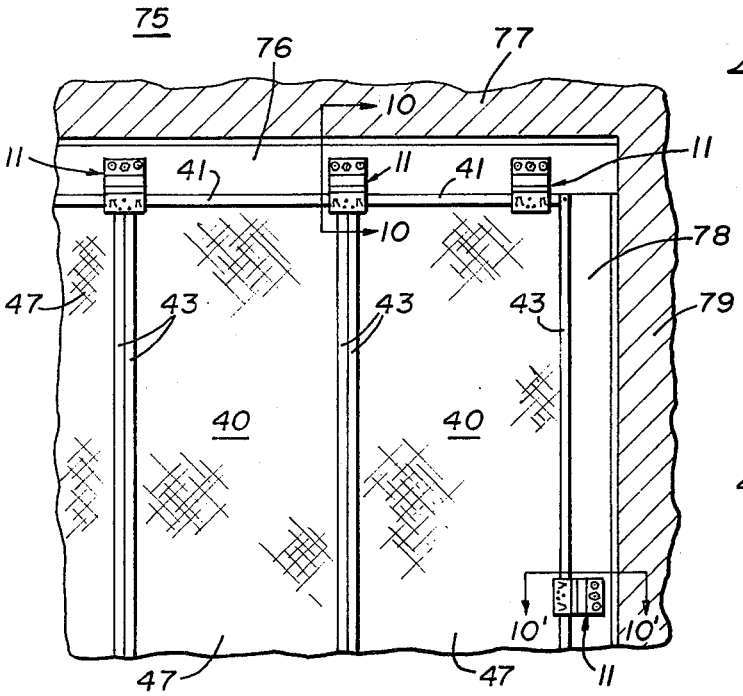
FIG. 9 is an elevational view of a fixed sound absorption wall in accordance with this invention wherein an individual hanger bracket member is utilized for securing sound absorption walls to fixed upper and side support members.
Figure 10:
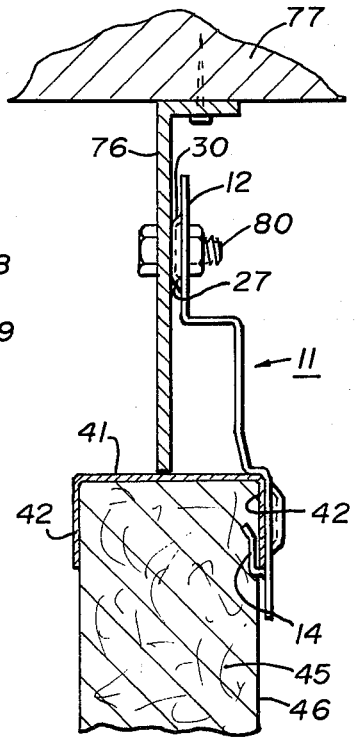
FIG. 10 is a cross-sectional view taken along both lines 10—10 and 10′—10′ of FIG. 9, looking in the direction of the arrows, showing the fixed support of the hanger bracket member as it engages panel top frames and panel side frame members to fixed horizontal and vertical support members.

FIGS. 9 and 10 disclose the preferred embodiment of this invention utilizing a single bracket member 11 for fixed sound absorption wall 75. A flanged upper support member 76 rigidly depends from a ceiling 77. Support member 76 is preferably shown to be a conventional roof substructure member having a depending flange. Similarly, a flanged side support 78 is shown in FIG. 9 extending outwardly from a wall structure 79. Flanged side support member 78 preferably has an outwardly extending engageable web as found in conventional structural elements.

With particular regard to FIG. 10, a cross-sectional view is shown taken along lines 10—10 and alternately along lines 10'—10'. The operability of bracket member 11 is thus shown for use in both horizontal and vertical support for fixed sound absorption wall 75. Connector means 80 attaches bracket member 11 to flange upper support members 76 and flanged side support member 78 by passing through aperture 31 of upper vertical plate 12. Connector means 80 is preferably shown to be a conventional nut and bolt fastener device. With this connection no engagement is made by any connection through openings 28 centered in pocket portions 27. The inward facing surfaces 30 simply abut planar surfaces of the support members, when the single bracket member 11 is used, which thereby offsets upper vertical plate 12 from flanged upper support member 76 a distance equal to the indentation provided for pocket portion 27.

As depicted in FIG. 10, punched-out tabs 14 engage depending lips 42 of panel frame 41 in similar manner shown in fixed sound absorption wall 50 of FIG. 4 and movable sound absorption wall 65 of FIG. 7. The difference with the preferred embodiment shown in FIG. 10 is that only an individual single bracket member 11 is used for support. The embodiment shown in FIGS. 9 and 10 comprises a sound absorption panel 40 having panel top frame member 41, panel side frame member 43 and panel facing 47. In this preferred embodiment it is again desirable that the panel frame extend about sound absorbing material 45 which is completely enclosed in a heat shrunk plastic bag 46. The panel facing 47 is provided as a perforated facing but however it is also an alternate embodiment to provide either a non-foraminous facing or eliminate the facing entirely.

It is thus seen from the preferred embodiments of the invention disclosed in FIGS. 1–10, and the foregoing description, that a hanger bracket 10 is disclosed useful in the fixed and the movable sound absorption wall systems. Hanger bracket members 11 combine to form hanger bracket 10. The hanger bracket 10 may engage an upper support member between upper vertical plates 12 or secure a channel support within the hollow rectangular opening 22. In the horizontally movable wall embodiment in accordance with this invention, a channel member may be provided to provide additional rigidity and stability but provide no support for the sound absorbing panels. Moreover, one single bracket member 11 is usable alone as a connective and supportive means in a fixed sound absorption wall system. As shown in FIGS. 4 and 7, adjoining panels may be connected by hanger bracket 10 wherein hanger bracket 10 is not engaged to a support member but merely acts as a connective device. Hanger bracket members 11 can combine for either supportive or connective functions interchangeably without need for other components or other interconnecting fastener means other than simple usage of conventional nuts, bolts and screw fasteners as disclosed. Although not shown in the drawings, the single bracket member 11 is useful as a connective device at the juncture of two adjoining panels wherein the single bracket member 11 engages the depending lips 42 of the adjoining sound absorption panels 40 to provide interconnection of panels without attachment to a support member.

In summary, it is seen that this invention provides a new and useful concept providing horizontally movable and fixed sound absorption walls utilizing a new hanger bracket design and sound absorption wall system. A significant advance has thus been provided for sound absorption systems providing noise abatement for industrial use.

Having fully described as no new and unique invention, the following is claimed:

1. A hanger bracket comprising two opposing substantially identical bracket members for securing one or more sound absorbing panels to a fixed support member wherein the bracket members comprising the hanger bracket are of one piece integral construction, said bracket members have upper and lower generally vertical plates residing in offset substantially parallel planes and the lower plate having at least one punched-out tab portion extending generally inward then upward from the lower plate and said members have a horizontal portion extending outwardly a distance less than one-half the width of the panel frame member at generally right angles to the upper plate from a lower edge thereof and said horizontal portion terminating at an edge opposite the upper plate in an intermediate vertical plate depending downwardly at generally right angles to the horizontal portion and said intermediate vertical portion having a lower skewed portion skewed obliquely outwardly therefrom and said skewed portion terminating at an edge opposite the intermediate vertical portion in a lip portion extending outwardly in a generally horizontal plane and said lip is connected at an edge opposite the said skewed portion to the lower vertical plate portion, said hanger bracket adapted to secure sound absorbing panels having a top frame member with a depending lip portion wherein said bracket members are opposingly connected to each other, and adapted to be secured to a support member by connector means at said upper vertical plates, whereby, said punched-out tab portions are adapted to engage the depending lip of a panel frame to thereby support the panel, and the lip portions of each bracket member positioned to contact opposing outer corner portions of a panel top frame and the vertical plate portions contact outer surfaces of the depending lip portions of a panel frame member, and said connected bracket members form a hollow generally rectangular opening therebetween.

2. A hanger bracket as in claim 1 wherein the lower vertical plates have one or more panel connector holes having screw fasteners engaged therethrough and engaged to the panel frame members, wherein the lower vertical plates have an outwardly extending embossment extending outwardly a distance sufficient to accomodate fastener heads located on the panel frame members at upper corners of the panel whereby a remaining inward planar surface of the lower vertical plate resides in substantially flush planar contact with planar panel frame surfaces without contacting the panel frame fastener heads, wherein the upper vertical plate of each bracket member has at least one inwardly indented pocket portion in positional correspondence with an inwardly indented pocket portion on the other, wherein the pocket portions have openings centered therein with connector means inserted therethrough connecting the bracket members one to the other and wherein the pocket portions abut one another at inward facing surfaces to thereby offset the upper vertical plates in parallel planar relationship, and, wherein the upper vertical plate of each bracket member has at least one aperture having connector means inserted therethrough connecting said bracket member to the support member.

3. A hanger bracket as in claim 1 wherein the support member comprises a box C-shaped channel member secured within the hollow generally rectangular bracket opening having sides being the intermediate vertical plates of the opposing bracket members, the bottom of the rectangular opening being the panel frame, and the top of the rectangular opening being the horizontal portions of the bracket members.

4. A hanger bracket comprising two opposing substantially identical bracket members for connecting two edge-to-edge adjacent sound absorbing panels wherein the bracket members comprising the hanger bracket are of one piece integral construction, said bracket members have upper and lower generally vertical plates residing in offset substantially parallel planes and the lower plate having at least two spaced apart punched-out tab portions extending generally inward then upward from the lower plate and said members have a horizontal portion extending outwardly a distance less than one-half the width of the panel frame member at generally right angles to the upper plate from a lower edge thereof and said horizontal portion terminating at an edge opposite the upper plate in an intermediate vertical plate depending downwardly at generally right angles to the horizontal portion and said intermediate vertical portion having a lower skewed portion skewed obliquely outwardly therefrom and said skewed portion terminating at an edge opposite the intermediate vertical portion in a lip portion extending outwardly in a generally horizontal plane and said lip is connected at an edge opposite the skewed portion to the lower vertical plate portion, said hanger bracket adapted to secure sound absorbing panels having a top frame member with depending lip portions wherein said bracket members are opposingly connected to each other by connector means at said upper vertical plates whereby, said spaced-apart tab portions of each bracket member engage depending lip portions of frame members of adjacent panels to thereby connect adjacent panels and the lip portions of each bracket member positioned to contact opposing upper outer corner portions of a panel top frame and the vertical plate portions positioned to contact outer surfaces of the depending lip portions of a panel frame member.

5. A hanger bracket as in claim 4 wherein the lower vertical plates have one or more panel connector holes having screw fasteners engaged therethrough and engaged to the panel frame members, and the lower vertical plates have an outwardly extending embossment extending outwardly a distance sufficient to accommodate fastener heads located on the panel frame members at upper corners of the panel whereby a remaining inward planar surface of the lower vertical plate resides in substantially flush planar contact with planar panel frame surfaces without contacting the panel frame fastener heads, wherein the upper vertical plate of each bracket member has at least one inwardly indented pocket portion in positional correspondence with an inwardly indented pocket portion on the other, wherein the pocket portions have openings centered therein with connector means inserted therethrough connecting the bracket members one to the other and wherein the pocket portions abut one another at inward facing surfaces to thereby offset the upper vertical plates in parallel planar relationship.

6. A hanger bracket comprising two opposing substantially identical bracket members for movably securing one or more sound absorbing panels to a horizontally movable trolley means movably attached to a support track means wherein the bracket members comprising the hanger bracket are of one piece integral construction, said bracket members have upper and lower generally vertical plates residing in offset substantially parallel planes and the lower plate having at least one punched-out tab portion extending generally inward then upward from the lower plate and said members have a horizontal portion extending outwardly a distance less than one-half the width of the panel frame member at generally right angles to the upper plate from a lower edge thereof and said horizontal portion terminating at an edge opposite the upper plate in an intermediate vertical plate depending downwardly at generally right angles to the horizontal portion and said intermediate vertical portion having a lower skewed portion skewed obliquely outwardly therefrom and said skewed portion terminating at an edge opposite the intermediate vertical portion in a lip portion extending outwardly in a generally horizontal plane and said lip is connected at an edge opposite the skewed portion to the lower vertical plate portion, said hanger bracket adapted to secure sound absorbing panels having a top frame member with a depending lip portion wherein said bracket members are opposingly connected to each other, and adapted to be secured to said trolley means at said upper vertical plates, whereby, said punched-out tab portions are adapted to engage the depending lip of a panel frame to thereby support the panel and provide horizontal movability in a path along the support track and the lip portions of each bracket member positioned to contact opposingly upper outer corner portions of a panel top frame and the vertical plate portions positioned to contact outer surfaces of the depending lip portions of a panel frame member.

7. A hanger bracket as in claim 6 wherein the lower vertical plates have one or more panel connector holes having screw fasteners engaged therethrough and engaged to the panel frame members, wherein the lower vertical plates have an outwardly extending embossment extending outwardly a distance sufficient to accommodate fastener heads located on the panel frame members at upper corners of the panel whereby a remaining inward planar surface of the lower vertical plate resides in substantially flush planar contact with planar panel frame surfaces without contacting the panel frame fastener heads, wherein the upper vertical plate of each bracket member has at least one inwardly indented pocket portion in positional correspondence with an inwardly indented pocket portion on the other, wherein the pocket portions have openings centered therein with connector means inserted therethrough connecting the bracket members one to the other and wherein the pocket portions abut one another at inward facing surfaces to thereby offset the upper vertical plates in parallel planar relationship, and, wherein the upper vertical plate of each bracket member has at least one aperture having connector means inserted therethrough connecting said bracket members to said horizontally movable trolley.

8. A hanger bracket member for securing one or more sound absorbing panels to a support member wherein the bracket member is comprised of one piece integral construction, said bracket member has upper and lower generally vertical plates residing in offset substantially parallel planes and the lower plate having at least one punched-out tab portion extending generally inward then upward from the lower plate and said member has a horizontal portion extending outwardly a distance less than one-half the width of the panel frame member at generally right angles to the upper plate from a lower edge thereof and said horizontal portion terminating at an edge opposite the upper plate in an intermediate vertical plate depending downwardly at generally right angles to the horizontal portion and said intermediate vertical portion having a lower skewed portion skewed obliquely outwardly therefrom and said skewed portion terminating at an edge opposite the intermediate vertical portion in a lip portion extending outwardly in a generally horizontal plane and said lip is connected at an edge opposite the skewed portion to the lower vertical plate portion, said hanger bracket member adapted to secure sound absorbing panels having a top frame member with a depending lip portion wherein said bracket member is adapted to be connected to a support member by connector means at said upper vertical plate, whereby, said punched-out tab portion engages the depending lip of a panel frame to thereby support the panel and the lip portion positioned to contact an upper outer corner portion of a panel top frame and the lower vertical plate portion positioned to contact an outer surface of the depending lip portion of a panel frame member.

9. A hanger bracket member as in claim 8 wherein the lower vertical plate has one or more panel connector holes having at least one screw fastener engaged therethrough and engaged to the panel frame member, wherein the lower vertical plate has an outward extending embossment extending outwardly a distance sufficient to accommodate fastener heads located on the panel frame member at upper corners of the panel whereby a remaining inward planar surface of the lower vertical plate resides in substantially flush planar contact with planar panel frame surfaces without contacting the panel frame fastener heads and, wherein the bracket member has two punched-out tab portions spaced apart a distance sufficient to engage the depending lip portions of two adjacent abutting panels both which are supported by said hanger bracket member.

10. A fixed sound absorption wall comprising: one or more sound absorption panels supported by top frame members having depending lip portions; a hanger bracket having two opposing substantially identical members engaging the top frame members; a support member; and, connector means connecting the bracket members to each other and securing the hanger bracket to the support member and thereby supporting the sound absorption panels wherein the bracket members comprising the hanger bracket are of one piece integral construction, said bracket members have upper and lower generally vertical plates residing in offset substantially parallel planes and the lower plate having at least one punched-out tab portion extending generally inward then upward from the lower plate, and said members have a horizontal portion extending outwardly a distance less than one-half the width of the panel frame member at generally right angles to the upper plate from a lower edge thereof and said horizontal portion terminating at an edge opposite the upper plate in an intermediate vertical plate depending downwardly at generally right angles to the horizontal portion and said intermediate vertical portion having a lower skewed portion skewed obliquely outwardly therefrom and said skewed portion terminating at an edge opposite the intermediate vertical portion in a lip portion extending outwardly in a generally horizontal plane and said lip is connected at an edge opposite the skewed portion to the lower vertical plate portion whereby, said bracket members are opposingly connected, and secured to the support member by connector means at said upper vertical plates, and, wherein said punched-out tab portions engage a depending lip of a panel frame to thereby support the panel and the lip portions of each bracket member contact opposing upper outer corner portions of the panel top frame and the vertical plate portions contact outer surfaces of the depending lip portions of the panel frame member and said connected bracket members form a hollow generally rectangular opening therebetween.

11. A sound absorption wall as in claim 10 wherein the lower vertical plates have one or more panel connector holes having screw fasteners engaged therethrough and engaged to the panel frame members.

12. A sound absorption wall as in claim 10 wherein the lower vertical plates have an outward extending embossment extending outwardly a distance sufficient to accommodate fastener heads located on the panel frame members at upper corners of the panel whereby a remaining inward planar surface of the lower vertical plate resides in substantially flush planar contact with planar panel frame surfaces without contacting the panel frame fastener heads.

13. A sound absorption wall as in claim 10 wherein the upper vertical plate of each bracket member has at least one inwardly indented pocket portion in positional correspondence with an inwardly indented pocket portion on the other, wherein the pocket portions have openings centered therein with connector means inserted therethrough to thereby connect the bracket members one to the other and wherein the pocket portions abut one another at inward facing surfaces to thereby offset the upper vertical plates in parallel planar relationship.

14. A sound absorption wall as in claim 10 wherein the upper vertical plate of each bracket member has at least one aperture therethrough having connector means inserted therein to connect said bracket member to the support member.

15. A sound absorption wall as in claim 10 wherein the support member comprises a channel member having a box C-shaped cross-section and having lips extending into both sides of the gap of the C wherein said channel member extends along the top frame of the panels and is secured within the hollow generally rectangular opening formed by the connected bracket members having sides being the intermediate vertical plates of the opposing bracket members, the bottom of the rectangular opening being the panel frame, and the top of the rectangular opening being the horizontal portions of the bracket members.

16. A sound absorption wall as in claim 15 wherein the gap of the C-shaped channel member is disposed downwardly.

17. A sound absorption wall as in claim 15 wherein the gap of the C-shaped channel member is disposed upwardly.

18. A horizontally movable sound absorption wall comprising: one or more sound absorption panels supported by top frame members; a hanger bracket having two opposing substantially identical members engaging the top frame member; a support track; a movable trolley means engaged to said support track for guiding movement along the track; and connector means for attaching said bracket members to the trolley means to support the panels and enable the panels to be moved horizontally in a path along the support track wherein the bracket members comprising the hanger bracket are of one piece integral construction, said bracket members have upper and lower generally vertical plates residing in offset substantially parallel planes and the lower plate having at least one punched-out tab portion extending generally inward then upward from the lower plate, and said members have a horizontal portion extending outwardly a distance less than one-half the width of the panel frame member at generally right angles to the upper plate from a lower edge thereof and said horizontal portion terminating at an edge opposite the upper plate at an intermediate vertical plate depending downwardly at generally right angles to the horizontal portion and said intermediate vertical portion having a lower skewed portion skewed obliquely outwardly therefrom and said skewed portion terminating at an edge opposite the intermediate vertical portion in a lip portion extending outwardly in a generally horizontal plane and said lip is connected to an edge opposite the skewed portion to the lower vertical plate portion whereby, said bracket members are opposingly connected to each other by connector means at said upper vertical plates, wherein the bracket members are connected to the trolley means at said upper vertical plates and, wherein said punched-out tab portions engage a depending lip of the panel frames to thereby support the panel and the lip portions of each bracket member contact opposing upper outer corner portions of the panel top frame and the vertical plate portions contact outer surfaces of the depending lip portions of the panel frame member and said connected bracket members form a hollow generally rectangular opening therebetween.

19. A horizontally movable sound absorption wall as in claim 18 wherein the lower vertical plates have one or more panel connector holes having screw fasteners engaged therethrough and engaged to the panel frame members.

20. A horizontally movable sound absorption wall as in claim 18 wherein the lower vertical plates have an outward extending embossment extending outwardly a distance sufficient to accommodate fastener heads located on the panel frame members at upper corners of the panel whereby a remaining inward planar surface of the lower vertical plate resides in substantially flush planar contact with planar panel frame surfaces without contacting the panel frame fastener heads.

21. A horizontally movable sound absorption wall as in claim 18 wherein the upper vertical plate of each bracket member has at least one inwardly indented pocket portion in positional correspondence with an inwardly indented pocket portion on the other, wherein the pocket portions have openings centered therein with connector means inserted therethrough to thereby connect the bracket members one to the other and wherein the pocket portions abut one another at inward facing surfaces to thereby offset the upper vertical plates in parallel planar relationship.

22. A horizontally movably sound absorption wall as in claim 18 wherein the upper vertical plate of each bracket member has at least one aperture having connector means inserted therethrough connecting said bracket members to said horizontally movable trolley.

23. A horizontally movable sound absorption wall as in claim 18 wherein additional strength and rigidity is provided in the sound absorption wall by positioning a channel member along the panels top frame said channel having a box C-shaped cross-section and having lips extending into both sides of the gap of the C wherein said channel member is secured within the hollow generally rectangular bracket opening having sides being the intermediate vertical plates of the opposing bracket members, the bottom of the rectangular opening being the panel frame, and the top of the rectangular opening being the horizontal portions of the bracket members.

24. A horizontally movable sound absorption wall as in claim 23 wherein the gap of the C-shaped member is disposed downwardly.

25. A horizontally movable sound absorption wall as in claim 23 wherein the gap of the C-shaped member is disposed upwardly.

* * * * *